US005930569A

United States Patent [19]

Roof, Jr. et al.

[11] Patent Number: 5,930,569

[45] Date of Patent: Jul. 27, 1999

[54] DEVELOPER ROLLS SYSTEM WITH REDUCED EDGE IMAGE DEFECTS

[75] Inventors: Norman L. Roof, Jr., Palmyra; Timothy P. Foley, Marion; Daniel R. Maurer, Fairport; Jacqueline M. Christensen, Webster; Cho Y. Sze, Fairport; Raymond L. Mongeon, Rochester, all of N.Y.

[73] Assignee: Xerox Corporation, Stamford, Conn.

[21] Appl. No.: 09/127,587

[22] Filed: Aug. 3, 1998

[51] Int. Cl.[6] ..... G03G 15/09

[52] U.S. Cl. ..... 399/269; 399/277

[58] Field of Search ..... 399/277, 269, 399/267

[56] References Cited

U.S. PATENT DOCUMENTS 3,572,289 3/1971 Maksymiak ..... 117/17.5

4,246,867 1/1981 Hudson ..... 118/655

*Primary Examiner*—Matthew S. Smith

*Assistant Examiner*—Greg Moldafsky

[57] ABSTRACT

An image development system for developing a latent image on an imaging surface, such as a xerographic photoreceptor, with plural development rollers having internal axially extending developer magnets with relatively offset axial end positions, and wherein at least one development roller has a smooth surface area at that same end, to reduce edge banding image defects from the interaction of the axial ends of the magnets of adjacent development rollers, especially for large size copy sheets being printed, such as B4 size. The image developer unit may have three development rollers with three different lengths of developer magnets to provide three different magnetic end positions staggered on opposite sides of the end position of the large sheet (relative to the imaging surface).

5 Claims, 4 Drawing Sheets

DEVELOPER ROLLS SYSTEM WITH REDUCED EDGE IMAGE DEFECTS

Figure 1:
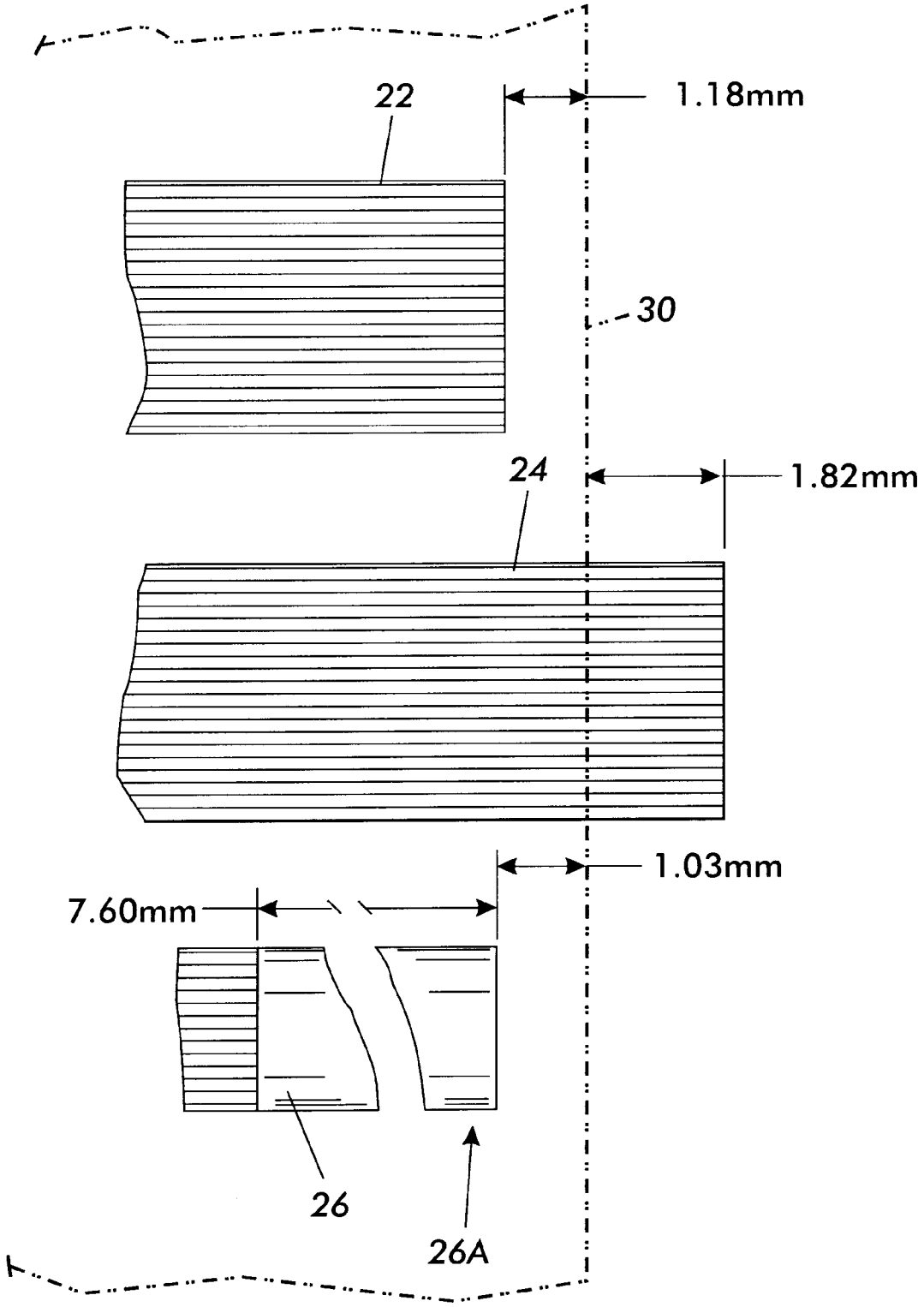

Disclosed in the embodiment herein is an improvement in image development systems for developing a latent image on an imaging surface with imaging material with plural magnetic development rollers. By changing the effective end relationships of the magnetic development rollers, with relatively minor and low cost modifications, problems may be prevented with a powder cloud development induced toner background band on the imaging surface from the interaction of the operative ends of the magnets of the plural development rollers, a problem which has occurred in prior conventional plural roller developers wherein the rollers are of identical magnetic length and magnetic end positions.

The general use, structure and operation of plural magnetic roller development systems is so well known in xerographic and related imaging arts as not to require discussion for those skilled in the art. As is well known, it is desirable to use plural adjacent magnetic developer rollers instead of single rollers to apply the image developer material to an imaging surface in higher speed machines where the photoreceptor belt or drum is moved rapidly by the development station so as to allow rapid printing without loss of image quality as compared to a single roller development system.

The embodiment disclosed herein and variations or equivalents thereof may be conventional in all other respects with various other such well known so-called magnetic roll development systems, wherein dry particulate imaging material is transported to the photoreceptor or other imaging surface in a layer on the outside surface of a thin shell cylindrical aluminum or other such rotating roller (which surface is conventionally knurled, grooved, or otherwise roughened) while the material, or a component thereof is attracted to the roller surface by internal stationary magnets extending axially inside the roll to attract imaging material to the outer surface of the roll. Typically, the rollers are rotatably driven relative to the imaging surface, closely adjacent to or contacting the imaging surface, to apply appropriate amounts of the imaging material to a latent electrostatic image on the imaging surface, which material is attracted from the roller to the imaging surface in an image-wise pattern, all as is well known in the art. Known imaging material may comprise so-called two component, or single component, image developer material. That is, it may comprise a two component mixture of magnetically attractable carrier beads and substantially non-magnetic fine dry particulate or powder-like toner, or a fine single component toner which is itself magnetically attractable. In two components systems, the toner is typically triboelectrically charged by mechanical agitation with the carrier admixture. Depending upon the type of development system, an electrical voltage bias between the developer rollers and the latent image, and/or high voltage charged wires, or the like, may be used to create appropriate electrical fields attracting the charged toner particles from the developer roller surfaces to the latent image on the imaging surface. As is also well known, the magnetic fields, both within a development roller and between the magnets of adjacent developer rollers, may also be positioned and configured to assist the toner particles to transfer or jump from the magnetic brush formed on the outer surface of the developer rolls to the latent image on the imaging surface. Deliberate or unintentional so-called powder cloud areas may be provided in spaces or gaps between developer rollers and the imaging surface, and/or between developer rollers.

The present invention is particularly directed to a problem which has been observed in some plural roll development systems in printing onto large image printing substrates, for example, Japanese B4 size paper or other wide copy sheets. Specifically, a problem when the width of the copy sheet to be printed (the dimension transverse the machine processing direction of movement) is wider than, or substantially the same width as, the magnetic length of the developer rollers, so that the edges of the large sheet of paper are adjacent to or extending beyond the magnetic ends of the developer rolls. There is a particular problem in some printers in long edge (widthwise) feeding and printing of such B4 size paper, which is 14.33 inches long. That is longer than the standard U.S. legal size 14 inch long paper for which many machines were designed to provide maximum size long edge feeding. That is, many machines were initially intended to only print paper of a lesser width, or to print larger sheets fed short edge first, i.e., lengthwise, so that the edges of the sheet of paper would not be adjacent to or extend beyond the magnetic ends of the developer rolls.

As is well understood by those skilled in the art, in xerography the paper copy substrate itself is not fed through the development system, rather the electrostatic latent image on the photoreceptor imaging surface is developed with toner as it is fed through the development system and is then further fed on the imaging surface to a downstream image transfer station where that developed image is transferred to the sheet or web of paper or other image substrate.

With smaller or narrower sheets of paper, any inadvertent transfer of toner to the imaging surface outside of the paper dimensions will not be transferred to the paper and therefore would never appear on the paper. It would simply be cleaned off in any subsequent downstream cleaning system of the printing apparatus. However, as disclosed here, where large paper sheets are being fed with a width corresponding to the magnetic length of the developer rolls of the machine, inadvertent transfer of imaging material to the imaging surface from developer roll end areas can be transferred to at least one outer edge of the copy sheet.

In particular, it has been discovered that fringe field magnetic effects associated with the interaction between the axial ends of the magnets of the plural developer rolls, and the mechanical agitation of the developer material, can cause a powder cloud development induced toner background band on the photoreceptor surface adjacent to the axial ends of the developer rolls. This toner background band on the photoreceptor can be transferred to large paper sizes, as noted above. It can also increase the amount of toner which can escape the developer housing and contaminate the interior of the printing apparatus. This defect has been noted on both the inboard and outboard sides of the developer housing, where (conventionally) the three developer rollers all have the same magnetic lengths with their magnetic ends all aligned in the process direction.

It has been discovered and disclosed herein that this development defect, characterized by a band of background toner at the outer edge of the development zone, can be eliminated by offsetting the magnetic ends of the magnetic brush rolls in a multiple roll development system. In the presently disclosed multiple roll development system, the lengths of the magnetics of the subsequent or downstream developer rolls are longer than those of the preceding developer roll(s). As further disclosed, this may be accomplished by shortening the magnetic length of roll one while increasing the magnetic lengths of roll two, and/or rolls two and three. It has been found that a difference in the magnetic lengths or end positions of adjacent development rollers of less than approximately three millimeters can eliminate the above-discussed print quality defect in large documents. Furthermore, it has also been found that a combination of the above feature or features with a smooth surface provided on an end area of the last or furthest downstream roller exterior (in contrast to the knurled or other roughened surface of the rest of the roller) provides in combination a significant improvement in solving the above-described problems.

A specific feature of the embodiment disclosed herein is to provide in an image development system for developing a latent image on an imaging surface with imaging material with an image developer unit having plural adjacent development rollers axially extending transversely of said imaging surface, said development rollers having integral axially extending developer magnets with magnetic ends, the improvement wherein:

said magnetic end positions of at least one end of at least one of said development rollers are offset relative to an adjacent said development roller magnetic end positions to reduce edge banding image defects.

Further specific features disclosed herein, individually or in combination, include those wherein said at least one said development roller has a substantially roughened exterior surface with a small smooth surface area at said at least one end area thereof; and/or wherein said imaging material comprises a magnetically attractable material comprising or including dry particulate toner; and/or wherein said combination of said offset magnetic end positions and said smooth end of said development roller prevent a powder cloud development induced toner background band on said imaging surface from the interaction of the axial ends of said magnets of said plural development rollers; and/or wherein said image developer unit comprises three said development rollers having three different lengths of said integral axially extending developer magnets to provide three different said magnetic end positions; and/or wherein said latent image on said imaging surface is for a B4 size image; and/or wherein at least two said magnetic end positions are staggered on opposite sides of an edge position of said image.

In the description herein the term "sheet" refers to a usually flimsy physical sheet of paper, plastic, or other suitable physical substrate for the images.

As to specific components of the subject apparatus, or alternatives therefor, it will be appreciated that, as is normally the case, some such components are known per se in other apparatus, applications or patents which may be additionally or alternatively used herein for appropriate teachings of additional or alternative details, features, and/or technical background. What is well known to those skilled in the art need not be described here.

Figure 2:
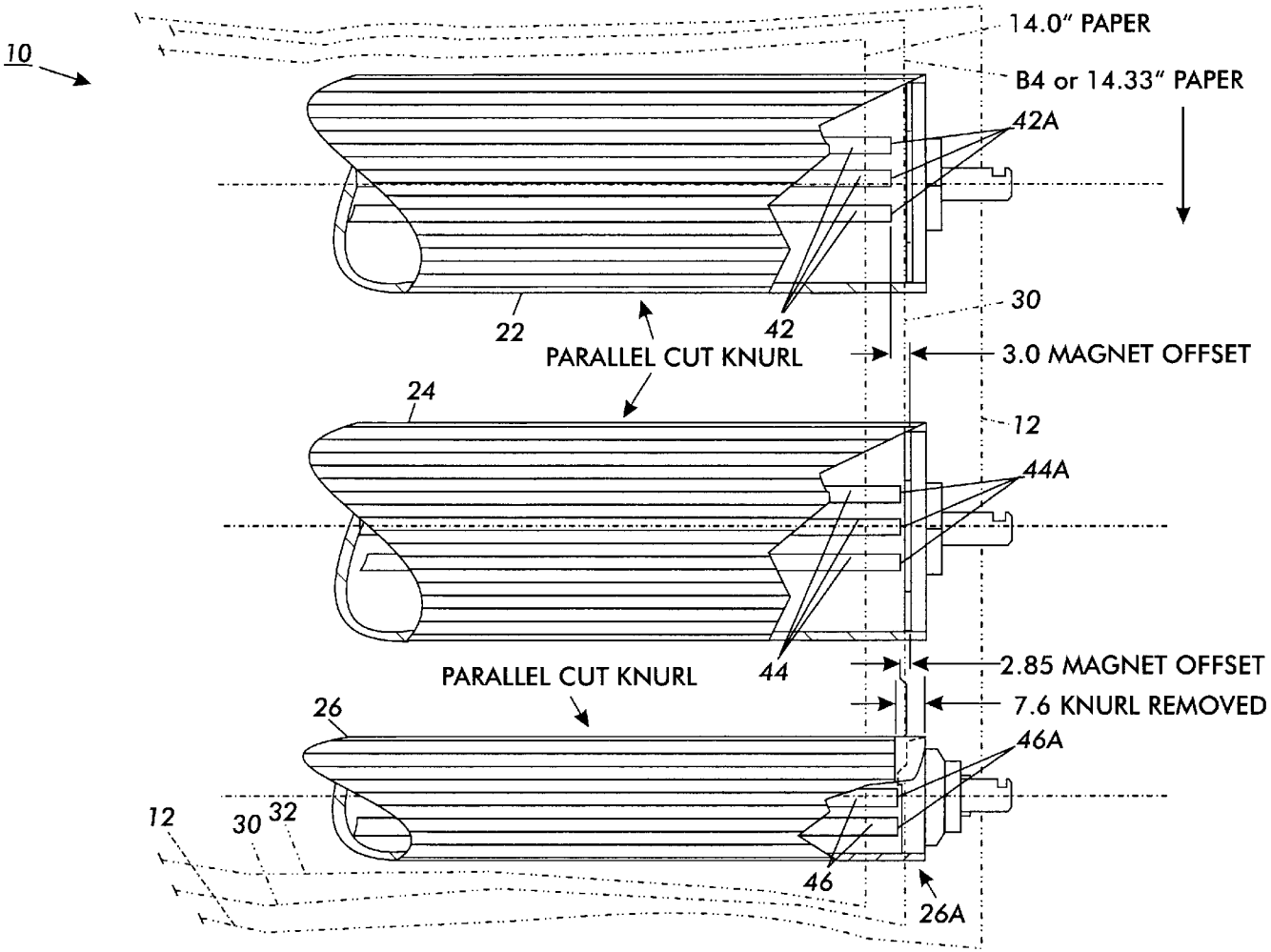
Figure 3:
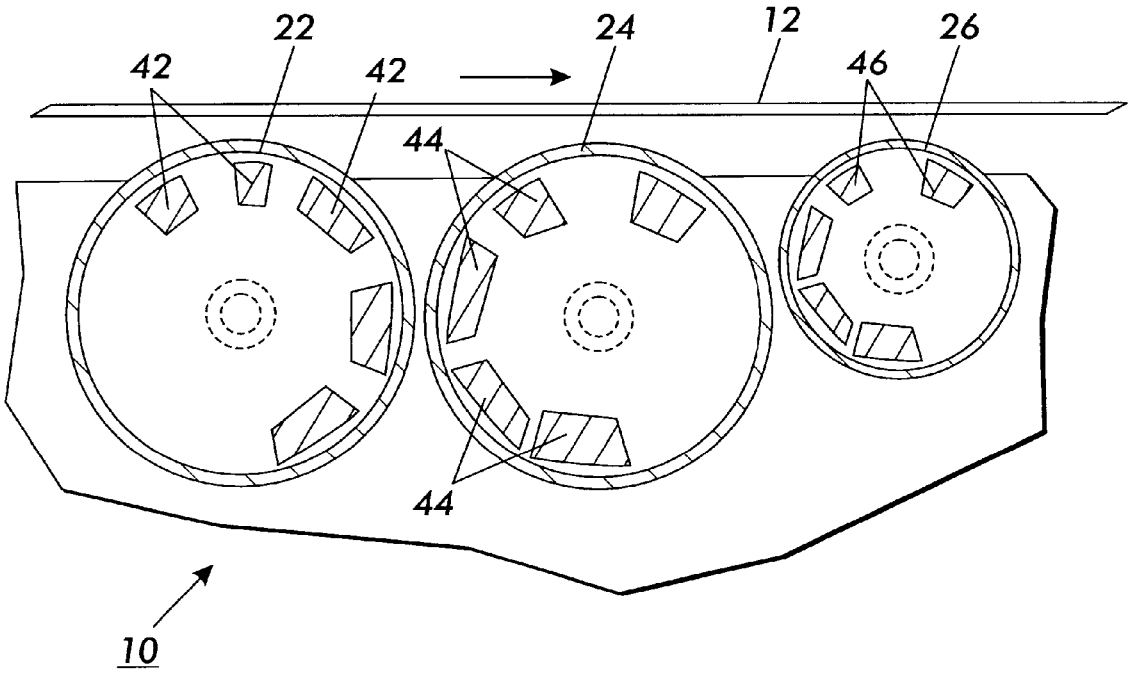
Figure 4:
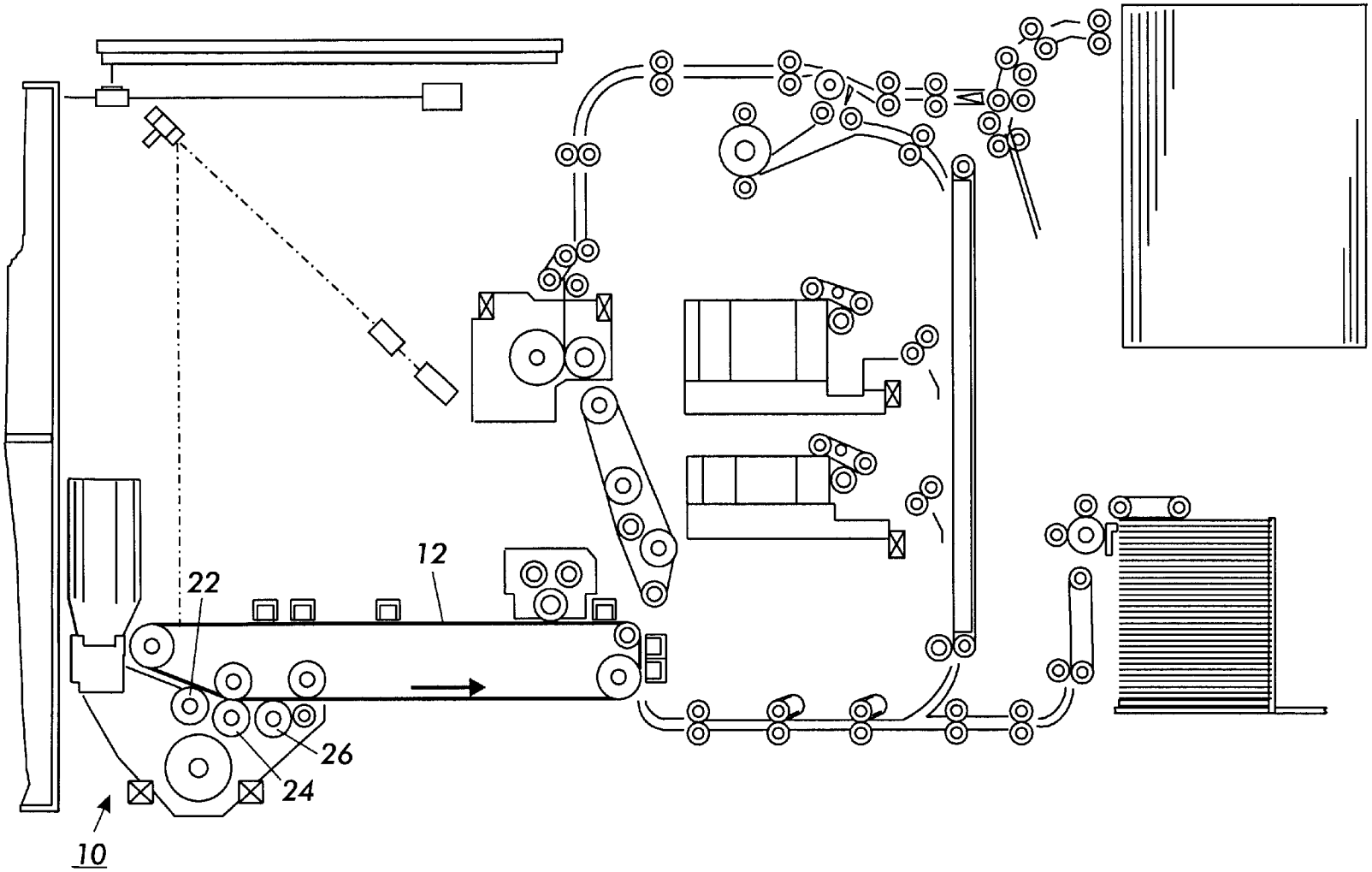

Various of the above-mentioned and further features and advantages will be apparent from the specific apparatus and its operation described in the example below, and the claims. Thus, the present invention will be better understood from this description of one specific embodiment, including the drawing figures (approximately to scale, except as noted) wherein:

FIG. 1 a schematic top view, not to scale, showing, with drawing exaggeration for clarity, the difference in axial lengths of the three rollers of an exemplary three roller magnetic image development system;

FIG. 2 top view of the three rollers of an exemplary three roll magnetic image development system cross-sectioned to show the interior magnets;

FIG. 3 is cross-sectional end view of the exemplary three roll magnetic image development system of FIG. 2; and FIG. 4 is an example of an otherwise conventional and well known printer shown as incorporating the exemplary image development system improvement of FIGS. 2 and 3.

As shown in the Figs, there is disclosed an otherwise conventional three roller magnetic developer unit 10 for developing latent images on the surface of a photoreceptor belt 12 in an otherwise conventional and well known manner. Accordingly, only the novel modifications noted above and below need be described in further detail.

The developer unit 10 here comprises a first developer roll 22, a second developer roll 24, and a third developer roll 26. All three developer rollers conventionally actually extend transversely of the imaging surface, that is, the photoreceptor belt 12. However, as will be described, the magnetic end positions of at least one end of at least one of these development rollers is offset relative to an adjacent development roller. Furthermore, at least one of these development rollers has, instead of an entirely roughened exterior surface as is conventional, a small smooth surface area on an end surface 26A.

These two features, especially their combination, have been found to overcome the above-described toner banding problem, even on large size copy sheets. That problem is particularly illustrated in FIG. 2, showing in phantom the relative positions of the edges of the photoreceptor belt 12 and the (subsequent downstream) positional outline of one edge of a B4 size (14.33" wide or 364 mm from the opposite edge position) paper sheet 30, a copy sheet which would otherwise have its outer edge area in a position to receive an undesirable toner banding or other defect from the magnetic ends of conventional developer rolls. The corresponding edge (end) position of 14" legal size paper sheets is shown by phantom line 32. As may be seen in FIG. 2, all three developer rolls may have existing conventional mountings aligned to the same inboard position.

As shown in this embodiment, in the developer unit 10, all three rollers 22, 24, 26 have sets of internal developer magnets 42, 44, and 46 of different lengths to provide respective different inboard end positions 42A, 44A, and 46A. The axial end position 42A of magnets 42 here in this example are, as shown, 1.18 mm inboard of the B4 sheet edge line 30, the end position 44A of magnets 44 are 1.82 mm outboard of the B4 sheet edge line 30, and the end position 46A of magnets 46 are 1.03 mm inboard of the B4 sheet edge line 30. However, that is not essential. It may also be possible for only roll two (roll 24) to have a different magnetic axial length, to extend outwardly at its outboard end further than roll one, so that the magnetic ends of rolls one and two (rolls 22 and 24) are staggered or offset from one another in the process direction, i.e., the direction in which the photoreceptor belt 12 is moving relative to the developer unit 10. However, as noted above, at least one magnetic end of the third development roll 26 may also desirably be axially offset, as in the example herein. This is all further illustratively exaggerated in FIG. 1. It will be appreciated that the magnetic lengths of the development rollers can be changed by changing the lengths of the magnets without changing the length of the developer roller or shell.

Furthermore, as indicated, here the inboard axial end portion of the exterior of the third roller 26 desirably has a smooth outer surface 26A. That smooth surface area 26A need only be approximately 8 millimeters or less in axial length. This can be accomplished, as in this example, simply by machining off the knurled outer surface of said inside or registration edge of the third developer roll 26 by 7.6 millimeters. This is also illustratively exaggerated in FIG. 1.

The three developer rollers shown in this example may all be horizontally aligned in their common housing to all sequentially engage the photoreceptor images on a horizontal segment of the photoreceptor sequentially moving past the rollers, but they are not limited to that orientation for other machines or applications. It will also be appreciated that a fourth magnetic roller may be added within the same developer unit, for a different purpose, namely, for carrier bead removal, as shown in FIG. 4. This is referred to as a "BRD roll". However, no modification or interrelation is required for this BRD roll, and this is a known additional feature which need not be re-described here.

It will also be understood by those skilled in the art that developer rolls are those which actually take part in the development of the image, and should not be confused with donor rolls or agitators which transport toner from a sump or other supply up to the developer rolls. Those and other such components of conventional magnetic brush development systems are well-known to those skilled in the art and need not be disclosed herein.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In an image development system for developing a latent image on an imaging surface with imaging material with an image developer unit having plural adjacent development rollers axially extending transversely of said imaging surface, said development rollers having integral axially extending developer magnets axially extending transversely of said imaging surface and terminating at magnetic end positions, the improvement wherein:

said magnetic end position of at least one of said development rollers is offset relative to an adjacent said development roller magnetic end position to reduce edge banding image defects.

2. The image development system of claim 1, wherein said at least one said development roller has a roughened exterior surface except for a minor end portion thereof which is smoother than said roughened surface.

3. The image development system of claim 2, wherein said imaging material comprises a magnetically attractable material comprising or including dry particulate toner, and wherein said offset magnetic end position and said smoother minor end portion of said development roller prevent a powder cloud development induced toner background band on said imaging surface from the interaction of said magnetic end positions of said magnets of said plural development rollers.

4. The image development system of claim 1, wherein said image developer unit comprises three said development rollers having three different lengths of said integral axially extending developer magnets to provide three different said magnetic end positions.

5. The image development system of claim 1, wherein said latent image on said imaging surface is for a B4 size image, and wherein at least two said magnetic end positions are staggered on opposite sides of an edge position of said image.

* * * * *